United States Patent [19]
Hartry et al.
[11] Patent Number: 4,549,462
[45] Date of Patent: Oct. 29, 1985

[54] APPARATUS AND METHOD FOR MOUNTING A HEAD ON A MUSICAL INSTRUMENT AND A METHOD OF DRUM CONSTRUCTION

[75] Inventors: Donald R. Hartry, La Canada; Remo D. Belli, Sherman Oaks, both of Calif.

[73] Assignee: Remo, Inc., North Hollywood, Calif.

[21] Appl. No.: 416,069

[22] Filed: Sep. 8, 1982

Related U.S. Application Data

[63] Continuation-in-part of Ser. No. 250,912, Apr. 3, 1981, Pat. No. 4,416,181.

[51] Int. Cl.[4] ..... G10D 13/02
[52] U.S. Cl. ..... 84/413; 84/414; 84/418
[58] Field of Search ..... 84/269–273, 84/411–420

[56] References Cited

U.S. PATENT DOCUMENTS

| | | | |
|---|---|---|---|
| 1,009,467 | 11/1911 | Bryant | 84/411 R |
| 2,979,981 | 4/1961 | Ludwig | 84/411 R |
| 3,250,169 | 5/1966 | Stone et al. | 84/417 |
| 3,459,093 | 8/1969 | Nishiura et al. | 84/411 R |
| 4,308,782 | 1/1982 | Hartry | 84/414 |
| 4,330,124 | 5/1982 | Vettorello | 84/418 X |
| 4,416,181 | 11/1983 | Hartry et al. | 84/272 |

FOREIGN PATENT DOCUMENTS

| | | | |
|---|---|---|---|
| 870046 | 7/1961 | United Kingdom | 84/411 R |

*Primary Examiner*—Lawrence R. Franklin
*Attorney, Agent, or Firm*—Lyon & Lyon

[57] ABSTRACT

A drum head assembly for use in drums, tambourines, banjos, or the like. A polymeric film is stretched across an annular member having a U-shaped channel formed in cross-section along its edge. The film is stretched and forced into the channel by plug member and is adhesively bonded therein. The plug member extends above the channel and receives a second, similarly shaped annular member over its exposed edge to provide a finished surface as well as an easy means for attaching the assembly to a musical instrument shell.

22 Claims, 11 Drawing Figures

APPARATUS AND METHOD FOR MOUNTING A HEAD ON A MUSICAL INSTRUMENT AND A METHOD OF DRUM CONSTRUCTION

CROSS REFERENCE TO RELATED APPLICATION

This application is a continuation-in-part of U.S. Ser. No. 250,912, filed 4/3/81 now U.S. Pat. No. 4,416,181. It is related to U.S. Pat. No. 4,356,756 of which Applicant, Donald R. Hartry, is the inventor. The disclosures of both patents are incorporated herein by reference.

BACKGROUND OF THE INVENTION

1. Field of the Invention

The present invention is directed to an apparatus and method for mounting a head on a musical instrument, such as a drum, tambourine, or banjo. More specifically, the apparatus and method of the present invention permit a head to be easily and quickly installed or removed from the shell of the instrument without the necessity of utilizing a clamping or similar means to secure the head to the musical instrument.

2. Description of the Prior Art

Various types of heads for drums, tambourines, banjos, and similar musical instruments have long been known in the art, as well as a variety of apparatus and methods for mounting such heads onto the instrument shell. For example, such heads range from the relatively unsophisticated, namely, the stretching of a piece of paper or fabric over an opening, to the very expensive drumheads used by professional drummers which utilize animal skins as well as advanced synthetic materials and elaborate clamping means to secure the head to the instrument shell and to provide variable tones of the desired quality.

However, the unsophisticated paper-like heads are, in reality, no more than just toys as they are not capable of producing an effective tone of sufficient musical quality, and are generally merely placed over the instrument shell and attached thereto by means of an adhesive or staples, tacks, and the like. Conversely, the heads utilized by professional drummers are not only very expensive, but also utilize an often cumbersome clamping means to secure the head to the instrument shell as well as to keep the head properly tensioned to provide the desired tonal quality. In the case of animal skin heads, a wetting and drying means is required to provide the desired tension. Thus, the replacement of a worn or torn head can be a time-consuming and often frustrating procedure since the clamping means must first be loosened to remove the old head and then subsequently tightened to retain and tension the new head. Many persons, however, desire an apparatus and method of mounting a head on a musical instrument which permits the head to be easily and quickly installed or removed from the instrument shell without the necessity of utilizing the clamping or similar means commonly used to secure the head to the instrument shell.

SUMMARY OF THE INVENTION

The present invention provides an apparatus and method for mounting a head on a musical instrument, such as a drum, tambourine, banjo, or the like, so that the head can be readily installed or removed from the instrument shell. Accordingly, in an exemplary embodiment, the apparatus comprises a first member having an opening therein with a channel formed along the edge thereof corresponding in shape to a cavity formed in a second member which is secured to or integrally formed along the edge of the musical instrument. The channel is preferably at least partially filled with a fast-acting adhesive, and as a polymeric film is stretched across the opening in the first member a plug is inserted into the channel such that it stretches and shapes the polymeric film as it forces the film into the channel to contact the adhesive. The channel in the first member is inserted into the cavity formed in the second member so that it is firmly engaged therein. In this fashion, the head construction can be easily installed or removed from the musical instrument by merely snapping the head construction into or out of the shell.

In an alternate construction, the polymeric film is stretched across the first member and its edges are inserted into the channel and are retained therein by means of an adhesive bond. No plug is used. In addition, the first member may be mounted on or removed from the shell of a musical instrument having a shoulder and an axially extending rim therefrom such that the head construction may be mounted either inside or over the rim and is secured thereto by means of a friction fit.

In still another alternate construction, the polymeric film is stretched across the first annular member having a channel formed along the edge, and is inserted into the channel and retained therein by means of an adhesive, but is stretched and forced into the channel by a plug member, the rim of which preferably extends above the edge of the channel. In the most convenient embodiment of this method, a complementary annular hoop is placed over the top of the plug member to provide a finished surface as well as an easy means for attaching the drumhead to a musical instrument shell.

The apparatus and method of the present invention are particularly suitable for use with non-tunable heads as described in U.S. Pat. No. 4,356,756.

As constructed with suitable polyester films which are described in the reference cited above, the drumheads which are obtained are themselves capable of producing sounds which are acceptable in terms of evaluation against the tone quality associated with finished drums. The drumheads can, in fact, be used alone rather than mounted as part of a musical instrument, and may thus be considered, themselves, to be "drums."

Accordingly, it is an object of this invention to provide an improved apparatus and method for mounting a head on a musical instrument.

It is a further object of this invention to provide an improved apparatus and method for mounting a head on a musical instrument which permits the head to be quickly and easily installed or removed from the instrument shell by merely snapping the head in place or popping it out.

It is another object of this invention to provide an improved apparatus and method for mounting a head on a musical instrument which does not require the use of a clamping or similar means to secure the head to the instrument shell.

It is still another object of this invention to provide an improved apparatus for mounting a head on a musical instrument which is simple and economical to manufacture.

It is still another object of the invention to provide a drumhead which possesses the esthetic and functional qualities of a drum.

The manner in which these and other objects and advantages of the invention are achieved will become apparent from the detailed description of the preferred embodiment which follows.

BRIEF DESCRIPTIONS OF DRAWINGS

FIG. 1 is a perspective view showing a non-tunable head mounted on a tambourine using the apparatus and method of the present invention.

FIG. 1A in a sectional detail showing the attachment of a polymeric film to the shell of a musical instrument by merely stretching the film across the opening in the shell and adhesively bonding it thereto.

FIG. 2 is an exploded sectional view showing the preferred head construction apparatus used to mount the non-tunable heads in the shell of a musical instrument.

Alternate embodiments shown in FIGS. 2A and 2B illustrate different ways of securing the ring 22 to the instrument shell.

DETAILED DESCRIPTION OF THE INVENTION

Figure 2:
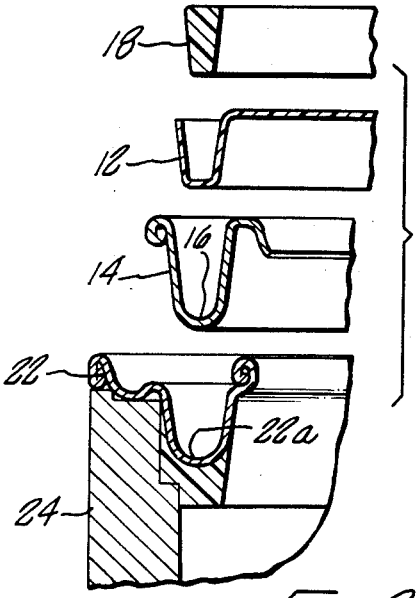

A preferred construction for mounting a head on a musical instrument as shown in FIG. 2 comprises an annular hoop 14 having a channel 16 formed along the edge thereof which corresponds in shape to a cavity **22*a* formed in an annular ring 22 which is secured or integrally formed along the edge of the shell 24 of the musical instrument. The channel 16 is preferably filled with a fast-acting adhesive, and a polymeric film 12 is stretched across the annular hoop. An annular plug 18 is inserted into the channel 16 such that the polymeric film is stretched as it is forced into the channel to contact the adhesive. The plug stretches and shapes the polymeric film as it is forced into the channel, which film is preferably adhesively bonded to the annular hoop to prevent any rattle when the head is struck by an object. The channel 16 firmly engages by means of a friction fit the similarly shaped cavity 22*a* in the annular ring, thereby enabling the head construction to be easily installed and removed from the musical instrument by merely snapping it into place or popping it out. In addition, the interior of the instrument shell 24 and 24*a* can be shaped in various ways to secure the annular ring 22** thereto, such as by a friction fit, or by the use of a suitable adhesive.

The apparatus and method described herein is most advantageously used with non-tunable heads which are formed as follows. A highly oriented crystalline polymeric film is immersed into a liquid solvent bath until the film swells to become sufficiently soft so that it can be draped. The film is then removed from the solvent bath and preferably mechanically wiped to remove solvent remaining on the surface of the film. Before the film dries, it is securely attached to a first member, such as an annular hoop of the apparatus of the present invention having a channel formed along the edge thereof. The film is then dried by allowing the solvent to evaporate. As the film dries, it shrinks to substantially its original dimensions. Since the film has been securely attached to the member, as it shrinks it becomes sufficiently tensioned to provide an effective musical tone when struck by an object.

The highly oriented crystalline polymeric film may be any polyester which has a sufficient modulus of elasticity to carry most of the tension load since it is the primary tension load carrier for the head. In order to avoid attendant vibration problems inherent in heads of increasing weight, the layer of polymeric film is preferably relatively thin, ranging from about 0.003 to about 0.014 inch in thickness. The thickness of the polymeric film is generally less in a drum head than in heads for other musical instruments, such as bongos. Moreover, while a cleaner tone is produced by a thinner polymeric film, the primary tension load carrier in a head must also provide sufficient strength for the head when it is struck by an object such as a drum stick or a hand. Consequently, layers of polymeric film which are substantially less than 0.003 inch in thickness generally do not appear to provide sufficient strength for the head.

A particularly preferred highly oriented crystalline polymeric film is the biaxially oriented film of the condensation polymer of ethylene glycol and terephthalic acid. Such a polymeric film is produced by E. I. DuPont de Nemours & Co., Inc. under the trademark MYLAR. MYLAR is not susceptible to moisture and changes in the weather, and has good flexibility, durability, and tensile strength. However, other highly oriented crystalline polyester films may also be successfully used in the practice of the present invention.

In addition, the polymeric film may be laminated to itself, or to a material which carries very little of the load when such a laminated head is tensioned, but rather provides a "cushioning effect" when struck by a drum stick or similar object by distributing load without transferring stress into the polymeric film. Consequently, it is not necessary that such a material swell in the solvent bath, nor does its lack of swelling appear to affect the degree of tension subsquently obtained due to the swelling of the polymeric film. Particularly preferred materials are polyethylene fabric materials having random fiber orientation, such as spunbonded olefins. Since these laminated materials are not relied upon to carry the tension load or to add strength or reinforce the head formed by the method of the present invention, this material may be relatively thin in order to reduce the weight of the head. Generally, the polyethylene fabric materials having random fiber orientation weigh from about 1.0 to 2.3 ounces per square yard and preferably from 1.3 to about 1.6 ounces per square yard. In addition to acting as a "cushion" to distribute the force of impact from a stick or similar object that strikes the playing surface, the laminated material reduces the tendency of the polymeric film to deform and form dents in the playing area, as well as damping undesirable overtones.

A particularly preferred spunbonded olefin fabric material which may be laminated to the polymeric film used in the heads formed by the method of the present invention is produced by E. I. DuPont de Nemours & Co., Inc. under the trademark TYVEK. TYVEK affords a playing surface very similar to natural skins, and presents a playing surface having improved brush response but without the moisture and temperature sensitivity of heads manufactured from natural skins. TYVEK also has good dimensional stability, high resistance to water-borne soiling agents, high tear strength, and high resistance to age degradation, although it may be treated to prevent degradation from ultraviolet rays from sunlight or from fluorescent lamps. It should be noted that TYVEK is particularly sensitive to many solvents and adhesives, and care must be taken in selecting the adhesive resin composition used in the lamination process, including the impregnating resin composition, and in the liquid solvent bath used in the present invention so as not to retard TYVEK's beneficial properties. Other synthetic fabric materials having a random fiber orientation may also be successfully used in the practice of the present invention, including a product marked under the trademark NOMEX by E. I. Dupont de Nemours & Co., Inc. and certain fiberglass materials having random fiber orientation. However, as fiberglass has a relatively high specific gravity, laminated heads employing such a fabric tend to weigh more, thereby increasing the potential of undesirable vibrations and reducing resonance and projection.

An elastomeric high density polyolefin adhesive is preferably applied to the polymeric film in thicknesses ranging from 0.001 to 0.006 inch to laminate it to the polyethylene fabric materials having random fiber orientation. A preferred high density polyolefin adhesive can be commercially purchased already applied to MYLAR in these thicknesses under the name of NAPLAM from General Binding Corp. in Northbrook, Ill.

Laminated heads suitable for use in the method of the present invention are more particularly described and set forth in U.S. Pat. No. 4,308,782, the disclosure of which is hereby incorporated by reference.

The liquid solvent bath may be any such bath commonly employed in the art which will completely cover the polymeric film as it is immersed therein. Solvents containing halogenated methane compounds are used as the liquid solvent to cause the polymeric film to swell. Particularly preferred solvents include methylene chloride and chloroform due to their fast action and quick drying. The solvent bath preferably remains at ambient temperature.

The polymeric film must be immersed in the liquid solvent bath until the film swells to become sufficiently soft so that it can be draped. In general, various types of polyester films have been found to swell up to approximately 5% areawise upon immersion in the liquid solvent bath. The period of time that the film must remain in the solvent bath to obtain the desired swelling will vary depending upon the type and thickness or weight of the film. For example, a sheet of MYLAR having a thickness of about 0.005 inch may be sufficiently swollen so that it can be draped after immersion in the solvent bath for approximately two hours, while a laminated material as described in U.S. Pat. No. 4,308,782 containing a sheet of TYVEK laminated to a sheet of MYLAR, may require between twenty to thirty hours until the MYLAR film swells to become sufficiently soft so that it can be draped.

When the film is removed from the solvent bath, it is preferably mechanically wiped in order to remove solvent remaining on the surface of the film. This mechanical wiping may take the form of a towel lightly rubbed across the surface of the film, or a stream of air may be directed at the surface of the film to blow off the solvent. If the film is to be adhesively bonded to the annular member, the solvent on the surface of the film must be removed to avoid interference with the adhesive bond.

Figure 1:
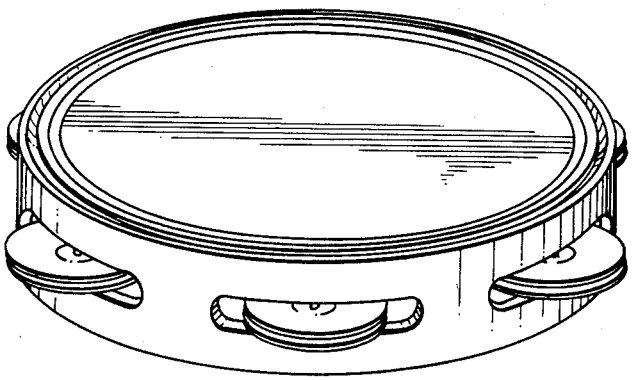
Figure 1A:
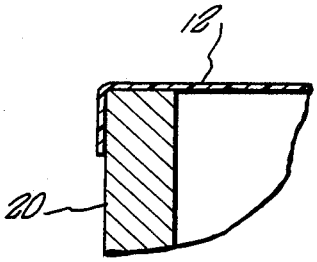

The film must be securely attached to a member having an opening therein, such as an annular member, e.g., an aluminum drum hoop, before it dries in order to obtain the necessary tension to provide an effective musical tone. Generally, the film may be attached to the member in a variety of ways, depending upon the musical instrument and its intended use. For example, as shown in FIG. 1A, the simplest method of attachment is merely stretching the polymeric film 12 across an annular member, such as a drum shell 20, and adhesively bonding the film to the outer periphery of the annular member by applying an adhesive thereto in a conventional manner and using a large hose clamp. The film may also be secured to the shell by staples, tacks, or the like.

Figure 2A:
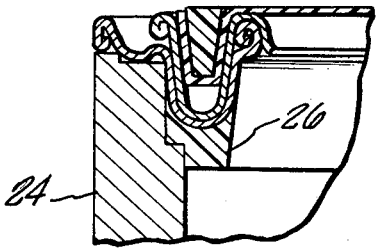
Figure 2B:
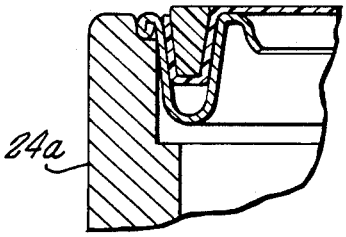

However, a preferred method of attaching the film to an annular member so that the head can be readily installed and removed from a musical instrument is shown in FIG. 2. The polymeric film 12 is stretched across an annular hoop 14 having a channel 16 formed therein. The channel may be of any suitable shape, but preferably has a generally U- or V-shaped cross-section as shown in FIGS. 2, 2A, and 2B, or a generally J-shaped cross-section. The channel is preferably at least partially filled with an adhesive, and an annular plug 18 is inserted into the channel formed in the annular hoop such that the polymeric film is stretched as it is forced into the channel to contact the adhesive. The plug stretches and shapes the polymeric film as it is forced into the channel, which film is preferably adhesively bonded to the annular hoop to prevent any rattle when the head is struck by an object. Thus, the plug, while essential in shaping and stretching the polymeric film to obtain a pre-tensioning of the film, is not believed to be essential in retaining the film in the channel since the film is securely adhesively bonded therein. Preferably, a fast-acting adhesive, such as a cyanoacrylate is used since it will set in a matter of minutes. Urethane and epoxy types may also be used. Suitable cyanoacrylate adhesives include "CA-5" from the 3M Company, and "240" from Permabond, a division of National Starch.

The annular hoop 14 corresponds in shape to an annular cavity **22*a* in an annular ring 22 which is secured or integrally formed along the edge of the shell 24 of the musical instrument. Since the channel 16 in the annular hoop firmly engages the similarly shaped cavity 22*a* in the annular ring as shown in FIG. 2A, the head can be easily installed and removed from the musical instrument. The interior of the instrument shell 24 and 24*a* can be shaped in various ways to retain the annular ring 22 secured thereto, such as by a friction fit, or by the use of adhesives. Two possible embodiments are shown in FIGS. 2A and 2B. As shown in FIG. 2A, a suitable adhesive composition 26, such as an epoxy or a polyurethane, may be employed to secure the annular ring 22 to the shell 24. This mounting apparatus is similar to the top of a paint can which easily snaps into or is removed from the rim on the can itself. Such a mounting construction is particularly suitable with tambourines as shown in FIG. 1** as it permits the instrument to be played either with or without the head, as the occasion may require, and the change can be easily and quickly accomplished by merely snapping the head into or out of the shell. In addition, this mounting construction also permits the quick and easy replacement of a worn or torn head.

Figure 4:
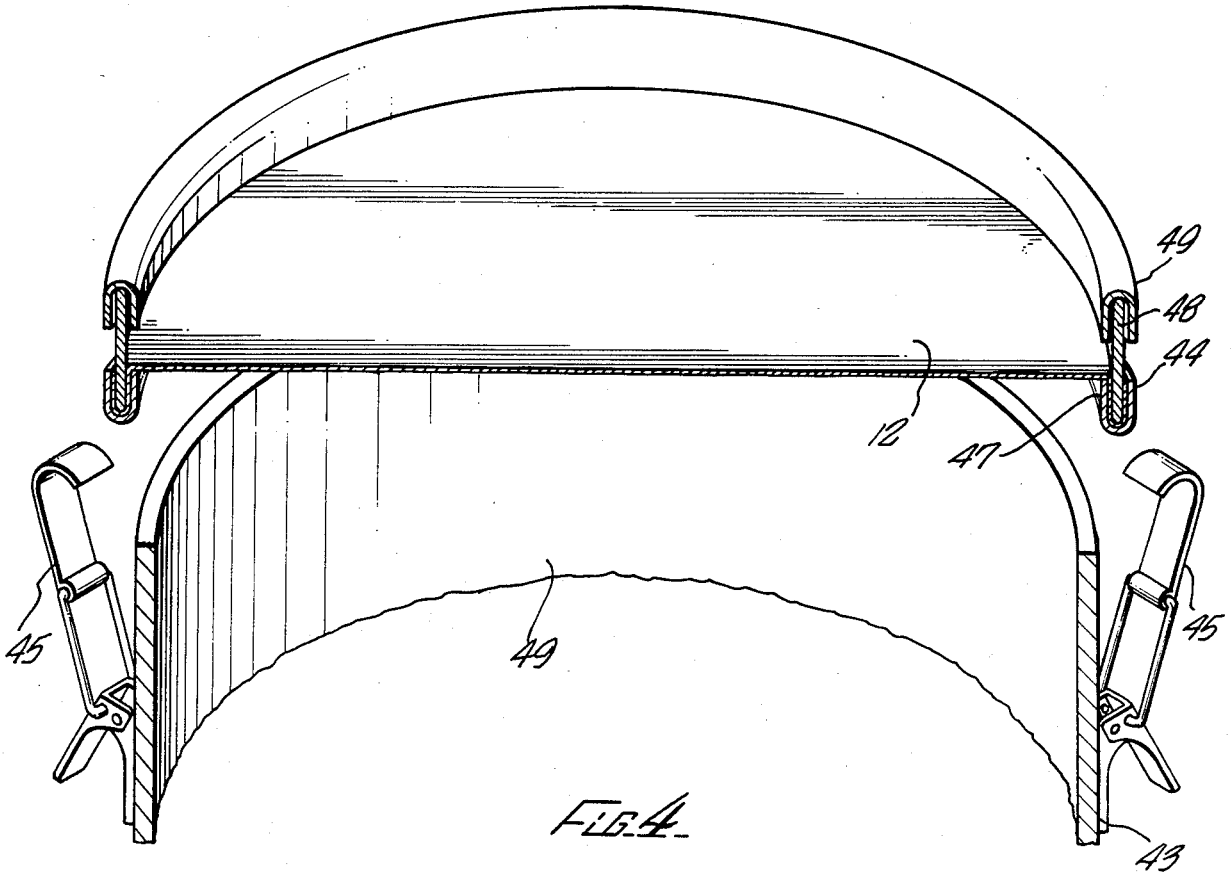
FIG. 4 shows a third preferred head construction, wherein the head can be snapped over the rim of a drum or other musical instrument, or used independently.
Figures 4A, 4B, 4C:
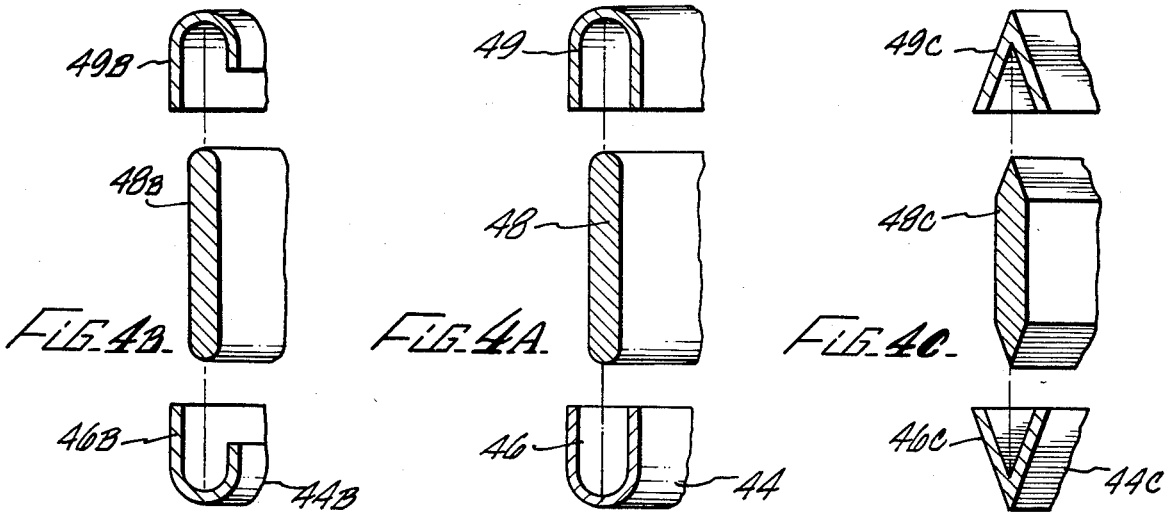
FIG. 4A is an exploded view of the construction of the support portion of the assembly shown in FIG. 4.
FIG. 4B is an exploded view of the construction of the support portion of the assembly shown in FIG. 4 in an alternative embodiment showing a J-channel.
FIG. 4C is an exploded view of the construction of the support portion of the assembly shown in FIG. 4 in an alternative embodiment showing a V-channel.

Another preferred method of constructing the drumhead is illustrated in FIGS. 4 and 4A. This method differs from the previous embodiment in the details of the design of the annular hoop arrangement, and in the provisions made for attachment of the resulting drumhead to the appropriate instrument. As was done in the embodiment previously, an annular member, preferably an aluminum drum hoop as set forth, is used. The hoop has a channel formed along its edge which may be shaped as a U, V, or J, but preferably as a U-shape cavity. The channel is preferably at least partially filled with an adhesive, preferably a fast-acting adhesive such as, for example, a cyanoacrylate. Suitable cyanoacrylate adhesives include "CA-5" from the 3M Company, and "240" from Permabond, a division of National Starch, as set forth herein above. Other suitable adhesives are standard epoxy and urethane types, preferably, for example, Shell Chemical 828 cured with Anchor XT curing agent, or the urethane Repco 201 A/C. The polymeric film is placed over the opening in the annular hoop so as to extend over the edges of the channel, and the annular plug member, 48 (FIGS. 4 and 4A) preferably constructed of aluminum is inserted onto the film and into the channel formed in the annular hoop such that the polymeric film is stretched as it is forced into the channel to contact the adhesive. The plug thus stretches and shapes the polymeric film as it is forced into the channel, and the film is adhesively bonded to the annular hoop. Thus, as above, the plug, while essential in shaping and stretching the polymeric film to obtain a pretensioning of the film, is not believed to be essential in retaining the film in the channel since the film is securely adhesively bonded therein. However, in this particular construction, the plug is capable also to serve the purpose, in a most preferred embodiment, of supporting a counterfacing substantially similar annular ring, which ring will, in turn, be helpful in attaching the drumhead securely to an instrument base and/or providing a finished appearance to the drumhead especially if it is to be used unmounted. To complete this most preferred embodiment, an annular ring 49 complementary to ring 44 is inserted on top of the plug so as to cover the opposite rim of the plug as shown, to form a sandwich assembly such that the construction is smoothly complete and esthetic. Alternative embodiments utilizing a J- and V-shaped channel are depicted in FIGS. 4B and 4C, respectively, wherein annular plug members 48B and 48C are utilized with annular rings 49B and 49C complementary to rings 44B and 44C.

In the construction of the supporing rim assemblies, the material of preference, as stated hereinabove for most applications, is aluminum of suitable gauge and dimension such that it is flexible enough to permit shaping into circular forms, and has sufficient rigidity to maintain the film vibration surface in position. However, other materials may also be used, and in particular situations may even be preferable to the aluminum construction. For example, stainless steel, wood stripping, and plastic materials of suitable combinations of rigidity and flexibility can be used. The material chosen, and dimensions and thicknesses which are appropriate, will depend on the musical instrument to be interfaced and the esthetic result desired.

As stated above, the second annular member is also helpful as a convenient means for securing the drumhead to a musical instrument cavity. However, it is not mandatory or even relevant in assuring the tone characteristics of the stretched polyester film 12. As most conveniently used, the completed drum head in its most preferred form is placed over a conformed hollow musical instrument cavity base, such as a drum cavity which comprises an annular hollow circumference which matches the inside face 47 of the lower annular ring. The drumhead is then conveniently clamped onto the drum cavity 43 by means of ordinary snap clamps 45. However, other commonly used means of securing the drumhead, such as spring clamps or bungy cords may also be used.

It is important to note that the drumhead assembly of the annular members, plug, and film as shown in FIG. 4 is pretuned as constructed, and does not require attachment to a musical instrument in order to operate effectively as a drum. The second annular member is also optional in achieving this characteristic. The attachment to the base musical instrument shell 24 merely serves to change the tone range of the resulting drum. The assembly which is unattached to any musical instrument may still serve effectively to produce the sound of a drum. In fact, it can be used independently using a clamp attachment to a music or other support stand as a low cost practice drum, or simply as hand held or otherwise supported so as to secure only the circumferencing annular assembly and leaving the film free to vibrate. In summary, as long as there is no impediment to the tensional response of the film to striking, and translational motion of the drumhead is prevented, a drum-like musical sound will result.

Figure 3:
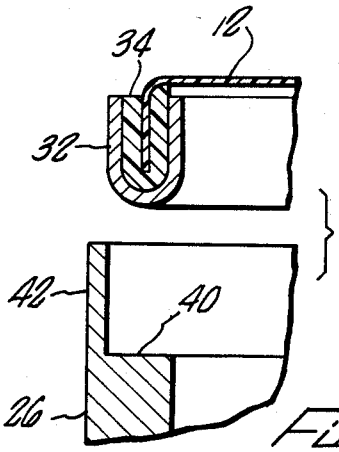
FIG. 3 is a sectional elevation showing a second preferred head construction apparatus wherein the head can be mounted inside the rim on the instrument shell.
Figure 3A:
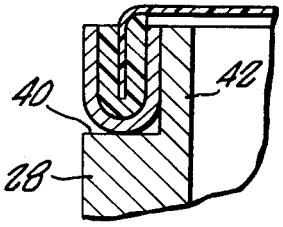
FIG. 3A is a sectional elevation similar to FIG. 3 showing how the head can be mounted over the rim of the instrument shell.

Another method of attaching the film to an annular member to form a non-tunable head by the method of the present invention is shown in FIG. 3. The film 12 is stretched across an annular hoop 32 with the edge being inserted into a channel formed in the annular hoop which has been at least partially filled with a fast setting adhesive 34, such as a cyanoacrylate. Also, epoxy and urethane type adhesives may be used, for example, Shell Chemical 828, cured with Anchor XT curing agent, or Repco 201 A/C. This head may then be readily mounted in or removed from a musical instrument with a shell 26 or 28 having a shoulder 40 and an axially extending rim therefrom 42 as shown in FIGS. 3 and 3A. The head may be mounted either inside the rim 42 as shown in FIG. 3 or over the rim as in FIG. 3A.

After the film has been securely attached to the annular member, it is then dried by allowing the solvent to evaporate. The evaporation may take as long as 24–48 hours, depending on the type and weight or thickness of the film. However, the solvent generally may be allowed to evaporate at room temperature as the addition of heat does not appear to substantially increase the rate of evaporation. As the solvent evaporates, the film shrinks to substantially its original dimensions. Since the film has been securely attached to the annular member, as it shrinks the film becomes sufficiently tensioned to provide an effective musical tone. The amount of tension provided by the shrinking will vary somewhat depending upon the period of time that the film was immersed in the solvent bath since the film appears to continue to swell, although by increasingly smaller amounts, the longer that it remains in the solvent. In addition, the final degree of tension ultimately achieved is also dependent upon the extent to which the film is stretched across the annular member as it is attached thereto before it dries. However, placing the polymeric film across the annular member and inserting an annular plug into the channel so that the film is stretched as it is forced in the channel as shown in FIG. 2 has been found to provide a suitable degree of stretching.

A preferred head for a drum, tambourine, banjo, or similar musical instrument can be formed using a MYLAR polyester film about 0.007 inch in thickness having a 0.001 inch thick layer of an elastomeric high density polyolefin adhesive on one side. The polyester film is laminated to a spunbonded olefin fabric material about 0.006 inch in thickness, such as TYVEK, as described in U.S. Pat. No. 4,308,782. This laminated film is immersed into a liquid solvent bath containing methylene chloride for about twenty to thirty hours to obtain a swelling of approximately 5% areawise. The film is then removed from the solvent bath, and the methylene chloride is removed from the surface of the film by directing a stream of air at the surface of the film to blow off the solvent. An aluminum annular drum hoop having a channel formed along the edge thereof is at least partially filled with a cyanoacrylate adhesive, and the film is placed across the hoop within about four or five minutes after removal from the bath by shaping it along its bonding surface, using suitable tooling known in the art to apply a force of about 2 lbs. per peripheral inch in order to stretch the film to bring it within 0.040 inch of the hoop. A pressure of approximately 15 p.s.i. is applied by the tooling for several minutes to allow for the preliminary set of the cyanoacrylate adhesive. The film is then dried by allowing the methylene chloride to evaporate from the film, taking from 36 to 48 hours under ambient conditions. In particular, the application of temperatures above 90° F. do not appear to advantageously aid the drying process. As the solvent evaporates, the film shrinks to substantially its original dimensions which induces sufficient tension in the film to provide an effective musical tone when struck by an object. This head construction may then be shaped into an annular ring having a cavity formed therein which corresponds in shape to the channel formed in the annular hoop, the ring being secured to or integrally formed along the edge of the instrument shell. The apparatus and method of mounting a head as described herein is particularly advantageously used with tambourines as shown in FIG. 1.

In addition, the apparatus and method for mounting a head on a musical instrument described herein may also be used with conventional materials which are not pretensioned. The annular hoop 14 is employed instead of the aluminum ring standard in the art, and it engages a conventional counterhoop. Other than the addition of the counterhoop, the apparatus and method remains the same.

While the preferred application of this invention has been shown and described, it would be apparent to those skilled in the art that many more modifications are possible without departing from the inventive concept herein described. The invention, therefore, is to be limited only by the lawful scope of the claims which follow.

We claim:

1. An apparatus for mounting a head on musical instrument comprising:

(a) a first annular hoop having a channel formed along the edge thereof;

(b) a polymeric film which is stretched across the opening in the annular hoop;

(c) an annular plug member which is inserted into the channel formed along the edge of the first annular hoop such that the polymeric film is shaped and stretched as it is forced into the channel by one rim of the plug member to contact an adhesive therein and such that the opposite rim of the plug member extends above the edges of the channel;

(d) a second annular hoop having a channel formed along the edge thereof substantially identical to the first annular hoop, and disposed in complementary fashion to the first annular member so that the channel covers the opposite rim of the plug member to form a drumhead assembly.

2. The apparatus of claim 1 wherein the polymeric film is a polyester.

3. The apparatus of claim 2 wherein the polymeric film is the biaxially oriented film of the condensation polymer of ethylene glycol and terephthalic acid.

4. The apparatus of claim 2 wherein the polyester film is laminated to a spunbonded olefin.

5. The apparatus of claim 1 wherein the channels have a generally U, V or J-shape configuration.

6. The apparatus of claim 1 wherein said apparatus is secured along the edges of the shell of a musical instrument cavity.

7. The method for manufacturing a drum, which method comprises:

(a) forming an annular member having a channel formed along the edge thereof;

(b) stretching a polymeric film across the opening in the annular hoop;

(c) inserting an annular plug member into the channel formed along the edge of the first annular hoop such that the polymeric film is shaped and stretched as it is forced into the channel by the rim of the plug member to contact an adhesive therein, and such that the opposite rim of the plug member extends above the edge of the channel;

(d) placing a second annular hoop having a channel formed along the edge thereof substantially identical to the first annular hoop in such a position that the opposite rim of the plug member is covered by the channel of the second annular member to form a drumhead assembly.

8. The method of claim 7 wherein the polymeric film is a polyester.

9. The method of claim 8 wherein the polyester film is the biaxially oriented film of the condensation polymer of ethylene glycol and terephthalic acid.

10. The method of claim 8 wherein the polyester film is laminated to a spunbonded olefin.

11. The method of claim 7 wherein each of the channels has a generally U, V or J-shape configuration.

12. The method of claim 7 which includes the step of placing the drumhead assembly over the shell of a musical instrument cavity and securing the drumhead assembly thereto.

13. The method of claim 12 wherein the musical instrument cavity comprises a rim which conforms to the inner surface of the annular member.

14. A drum comprising:

(a) a first annular member having a channel formed along the edge thereof;

(b) a polymeric film which is stretched across the opening in said first member;

(c) a plug member which is inserted into the channel formed along the edge of the first annular member such that the polymeric film is shaped and stretched as it is forced into the channel to contact an adhesive therein and said plug member extends above the channel of the first annular member; and (d) a second annular member having a channel formed along the edge thereof disposed in complementary fashion to the first annular member and covering the extension of the plug member.

15. The drum of claim 14 wherein the film is a polyester.

16. The drum of claim 15 wherein the polyester film is the biaxially oriented film of the condensation polymer of ethylene glycol and terephthalic acid.

17. The drum of claim 14 wherein the film is a lamination of at least two layers.

18. The drum of claim 17 wherein at least one layer of the lamination is a polyester film.

19. The drum of claim 18 wherein the polyester film is the biaxially oriented film of the condensation polymer of ethylene glycol and terephthalic acid.

20. The drum of claim 17 wherein the lamination comprises a polyester film laminated to a spunbonded olefin.

21. The drum of claim 14 wherein said drum is secured along the edge of the shell of a musical instrument cavity.

22. The drum as in claim 14 wherein the channel in each annular member has a generally J, V or U-shape configuration.

* * * * *